US005451482A

United States Patent [19]

Law et al.

[11] Patent Number: 5,451,482

[45] Date of Patent: Sep. 19, 1995

[54] TONER COMPOSITIONS WITH HYDROXY NAPHTHOIC ACID CHARGE ENHANCING ADDITIVES

[75] Inventors: Kock-Yee Law, Penfield; Ihor W. Tarnawskyj, Webster, both of N.Y.

[73] Assignee: Xerox Corporation, Stamford, Conn.

[21] Appl. No.: 238,072

[22] Filed: May 2, 1994

[51] Int. Cl.[6] ..... G03G 9/097

[52] U.S. Cl. ..... 430/110; 430/106.6; 430/106

[58] Field of Search ..... 430/110, 106.6, 106

[56] References Cited

U.S. PATENT DOCUMENTS

| | | | |
|---|---|---|---|
| 3,335,168 | 8/1967 | Dehn et al. | 260/465 |
| 4,656,112 | 4/1987 | Kawagishi et al. | 430/110 |
| 5,200,288 | 4/1993 | Ando et al. | 430/110 |
| 5,250,379 | 10/1993 | Bayley et al. | 430/106.6 |
| 5,250,380 | 10/1993 | Bayley et al. | 430/106.6 |
| 5,250,381 | 10/1993 | Ciccarelli et al. | 430/106.6 |
| 5,256,514 | 10/1993 | Law et al. | 430/106.6 |
| 5,256,515 | 10/1993 | Law et al. | 430/106.6 |
| 5,346,795 | 9/1994 | Pickering et al. | 430/110 |

FOREIGN PATENT DOCUMENTS 43076 1/1992 Japan .

*Primary Examiner*—Christopher D. Rodee
*Attorney, Agent, or Firm*—John L. Haack

[57] ABSTRACT

Disclosed is a negatively charged toner composition comprised of resin particles, pigment particles, optional surface additives, and a hydroxy naphthoic acid charge enhancing additive of the following formula:

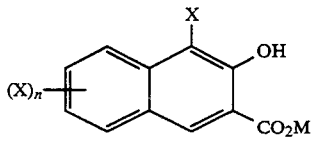

wherein X is halogen, hydroxy, or hydrogen, M is hydrogen, an alkaline earth, an alkali metal, or $NR_4$ wherein R is alkyl with from 1 to 5 carbon atoms, and n is the number 1 or 2.

22 Claims, No Drawings

TONER COMPOSITIONS WITH HYDROXY NAPHTHOIC ACID CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In one embodiment, there are provided in accordance with the present invention toner compositions comprised of resin particles, pigment particles and certain charge enhancing additives. In embodiments, the present invention is directed to toners with hydroxy naphthoic acid derivative charge enhancing additives. The aforementioned charge additives in embodiments of the present invention enable, for example, toners with high, that is from about −10 to about −50 microcoulombs per gram as determined by known methods like the Faraday Cage, triboelectric properties, rapid triboelectric charging characteristics, extended developer life, triboelectrical properties which change systematically with environmental conditions, for example, the toner triboelectric charging is from about −15 to about −30 microcoulombs/gram at a relative humidity of 20 percent, and from about −30 to about −50 microcoulombs/gram at a relative humidity of 80 percent, and high image print quality with substantially no background deposits. Also, the aforementioned toner compositions usually contain a colorant component comprised of, for example, carbon black, magnetites, or mixtures thereof, color pigments or dyes with cyan, magenta, yellow, blue, green, red, or brown color, or mixtures thereof thereby providing for the development and generation of black and/or colored images. The toner and developer compositions of the present invention can be selected for electrophotographic, especially xerographic, imaging and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003, there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A fast rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another disadvantage with these charge additives is their thermal instability, that is they often break down during the thermal extrusion process of the toner manufacturing cycle. Most or many of these and other disadvantages are eliminated, or substantially eliminated with the toners containing the charge additives of the present invention. Toners with various charge additive including aluminum complexes are disclosed, for example, in U.S. Pat. Nos. 4,404,271; 4,656,112; 4,762,763; 4,845,003; 4,767,688; 4,378,420 and 4,433,040.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, discloses developer compositions containing as charge enhancing additives organic sulfate and sulfonates, which additives can impart a positive charge to the toner composition; and U.S. Pat. No. 4,298,672, the disclosure of which is totally incorporated herein by reference, discloses positively charged toner compositions with resins and pigment particles, and as charge enhancing additives alkyl pyridinium compounds.

Negatively charged toners are illustrated in U.S. Pat. No. 5,250,379, issued Oct. 5, 1993, to Bayley et al., which illustrates a negatively charged toner composition comprised of resin, pigment, and an aluminum charge enhancing additive of the following formula

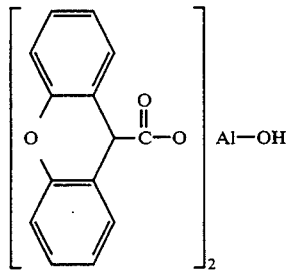

Illustrated in U.S. Pat. No. 5,275,900, issued Jan. 4, 1994, to Ong et al., are toner compositions comprised of polymer resins, colorants comprised of color pigment particles or dye molecules, and certain metal complex charge additives derived from the reaction of a mixture of a hydroxybenzoic acid and a base with a metal ion in the presence of an excess of a hydroxyphenol. More specifically, this copending application illustrates a negatively charged toner composition comprised of polymer, colorant, optional surface additives, and a metal complex charge enhancing additive of the following formula

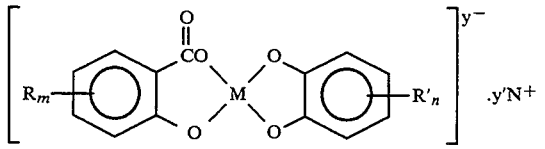

where M is a metal; $N^+$ is a cation; R and R′ are alkyl, alkoxy, aryloxy, halogen, carbonyl, amino, nitro, or mixtures thereof; m and n are the number of R substituents ranging from 0 to 3; $y^-$ is the magnitude of the negative charge of the anion; and y′ represents the number of cations.

Illustrated in U.S. Pat. No. 5,300,387, issued Apr. 4, 1994, to Ong, is a negatively charged toner composition comprised of a polymer or polymers, pigment, and a metal complex charge enhancing additive as essentially represented by the following formula

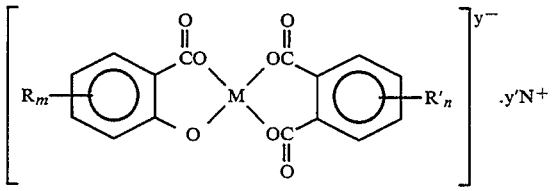

where M is the central metal ion; $N^+$ is the counter cation; R and R′ are selected from the group consisting of alkyl, alkoxy, aryloxy, halogen, carbonyl group, alkoxycarbonyl group, amino group, nitro group or mixtures thereof; m and n are the number of R substituents on the aromatic rings, ranging from 0 to 3; $y^-$ is the magnitude of the negative charge of the anion or the number of the counter cations of the metal complex, and represents the number 1 or 2; and y′ represents the number of countercations $N^+$.

Illustrated in copending application U.S. Ser. No. 964,544 is a toner composition comprised of a polymer or polymers, pigment particles and/or dyes, optional surface additives, and a charge enhancing additive of the following formula

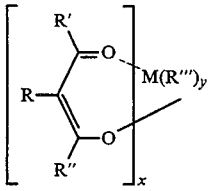

wherein R is hydrogen, alkyl, or aryl, R′ and R″ are selected from the group consisting of alkyl, alkoxy, aryl, and aryloxy, R‴ is selected from the group consisting of alkyl, alkoxy, oxide, and halide, M is boron or a metal, x is a number of from 1 to 4, and y is a number of from 0 to 2.

Illustrated in U.S. Pat. No. 5,290,651, issued Mar. 1, 1994, to Ong, is a negatively charged toner composition comprised of polymer, pigment, optional surface additives, and a zinc complex charge enhancing additive represented by either of the two following formulas:

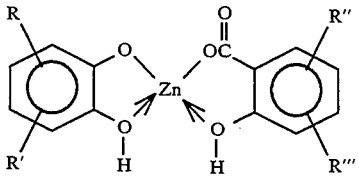

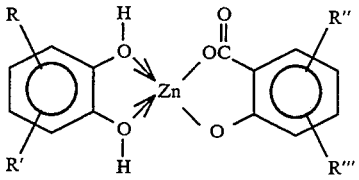

wherein R, R′, R″, and R‴ are independently selected from the group consisting of hydrogen, alkyl, aryl alkoxy, aryloxy, halogen, amino, and hydroxy.

Illustrated in U.S. Pat. Nos. 5,256,514 and 5,256,515, issued Oct. 26, 1993 to Law et al., are negatively charged toner compositions comprised of resin particles, pigment particles, optional surface additives and halogenated salicyclic acid and metal complex derivative charge enhancing additives of the following formulas, respectively as defined therein.

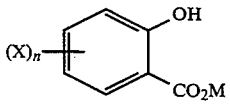

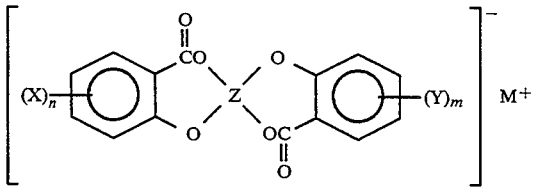

The disclosures of each of the aforementioned copending applications and U.S. Patents are totally incorporated herein by reference.

Although many charge enhancing additives are known, there continues to be a need for charge enhancing additives which when incorporated in toners, render the toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. There is also a need for toner compositions containing charge additives which do not contain transition metals or heavy metals as a constituent of the charge additive component. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of, for example, from between about −10 to about −50 microcoulombs per gram, and preferably from about −15 to about −45 microcoulombs per gram, and triboelectric charging rates of less about 120 seconds, and preferably from about 15 to about 60 seconds as measured by standard charge spectrograph methods when the toners are frictionally charged against suitable carrier particles via conventional roll milling techniques. There is also a need for metal free, nontoxic, substantially nontoxic, or environmentally compatible charge enhancing additives which when incorporated at effective concentrations of, for example, less than 7 weight percent, preferably less than 4 weight percent in toners, render the toners to be xerographically and environmentally efficacious. The concentrations of the charge additives that can be incorporated into the toner compositions generally range from about 0.05 weight percent to about 5 weight percent, depending on whether the charge additive is utilized as a surface additive or as a dispersion in the bulk of the toner. The effective concentrations of toner in the developer, that is toner and carrier particles, are, for example, from about 0.5 to about 5 weight percent, preferably from about 1 to about 3 weight percent. There is also a need for charge additives that can charge toners with small particle diameters of, for example, less than about 7 microns, and more specifically from about 2 to 7 microns in average volume diameter. Another need relates to toner and developer tribocharging characteristics which are insensitive to RH or where the tribo does not decrease at high RH, and alternatively, to tribo characteristics which vary systematically with ambient relative humidity, in particular, a triboelectric charging characteristic which becomes more negative from about −15 to about −45 microcoulombs per gram as the relative humidity increases over the range of about 20 to about 80 percent.

SUMMARY OF THE INVENTION

It is an object of the present invention to provide toner and developer compositions with negative charge enhancing additives.

It is an object of the present invention to provide economically negatively charged toner compositions useful for the development of electrostatic latent images including color images.

In yet a further object of the present invention there are provided, it is believed, humidity insensitive triboelectrically stable developer compositions and humidity advantageous developer compositions wherein the triboelectric charge levels improve, that is, become more negative, with increasing relative humidity, from about, for example, 20 to 85 percent relative humidity at temperatures of from 60 to 80° F. as determined in a relative humidity testing chamber, negatively charged toner compositions with desirable triboelectric charging rates of less than 120 seconds, and preferably less than 60 seconds as determined by the charge spectrograph method, and acceptable triboelectric charging levels of from about −10 to about −50 microcoulombs per gram.

Another object of the present invention resides in the preparation of negative toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is for example those exceeding 50 copies per minute.

These and other objects of the present invention may be accomplished in embodiments thereof by providing toner compositions comprised of polymer resins, colorants comprised of color pigment particles or dye molecules, and certain charge additives. More specifically, the present invention in embodiments is directed to a negatively charged toner composition comprised of resin particles, pigment particles, optional surface additives, and a hydroxy naphthoic acid charge enhancing additive of the following formula:

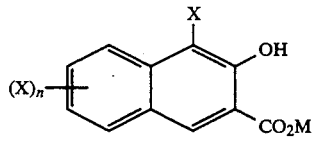

wherein X is halogen such as bromide or iodide, hydroxy, or hydrogen, M is hydrogen, an alkaline earth such as magnesium calcium, barium, and the like metal, an alkali metal such as lithium, sodium, potassium, and the like, or $NR_4$ wherein R is alkyl, and n is the number 1 or 2.

Examples of alkyl include known substituents such as those with 1 to about 25 carbon atoms, such as methyl, ethyl, propyl, butyl, pentyl, hexyl, octyl, nonyl, and the like.

Examples of specific charge additives of the present invention include, but are not limited to 1,6-dibromo-2-hydroxy-3-naphthoic acid, lithium 1,6-dibromo-2-hydroxy-3-naphthoate, 2-hydroxy-6-bromo-3-naphhthoic acid, lithium 2-hydroxy-6-bromo-3-naphthoate, sodium 2-hydroxy-6-bromo-3-naphthoate, 1,6-diiodo-2-hydroxy-3-naphthoic acid, and 2-hydroxy-3-naphthoic acid.

The aforementioned charge additives can be incorporated into the toner, may be present on the toner surface, or may be present on toner surface additives such as colloidal silica particles The charge additives are present in the toner composition in effective amounts of from about 0.01 to about 5 weight percent and preferably from about 0.1 to about 3 weight percent based on the total weight of the toner composition. Advantages of rapid triboelectric charging characteristics of generally less than 120 seconds, and preferably less than 60 seconds in embodiments as measured by the standard charge spectrograph methods when the toners are frictionally charged against carrier particles by known conventional roll mixing methods, appropriate triboelectric charge levels, and the like can be achieved with many of the aforementioned toners of the present invention. In embodiments, when the aforementioned charge additives are included in the toner composition in the manner specified above, the rate of tribocharging of the resultant toner is from about 15 seconds to about 120 seconds as measured by frictional charging methods against suitable carrier particles. In another embodiment of the present invention, there are provided, subsequent to known micronization and classification, toner particles with a volume average diameter of from about 4 to about 20 microns.

The hydroxy naphthoic acid, used as a starting material for the preparation of the hydroxy naphthoic derivative charge additives of the present invention, is commercially available from, for example, Aldrich Chemical Company. The alkali and alkaline salts of hydroxy naphthoic acid and halogenated derivatives thereof can be prepared by, for example, adding thereto an equivalent molar amount of a metal hydroxide to an alcoholic, such as methanolic solution of the hydroxynaphthoic acid, followed by removal of the alcoholic solvent. The halogenated hydroxy naphthoic acid derivatives can be prepared using known halogenation procedures, for example, treating a solution of hydroxy naphthoic acid in acetic acid with molecular bromine.

A number of equally useful halogenating agents are known that afford halogenated reaction products at selected sites in aromatic compounds, for example, as disclosed by House in "Modern Synthetic Reactions", W. A. Benjamin, Inc., 2nd Ed., Chapter 8, page 422, and references cited therein, the disclosure of which is incorporated in its entirety by reference.

From the foregoing, it is readily evident to one of ordinary skill in the art that a variety of halogen substituted hydroxy naphthoic acid compounds and metal salt derivatives thereof may be prepared.

The toner compositions of the present invention can be prepared by a number of known methods such as admixing and heating polymer resins such as styrene butadiene copolymers, polyesters, such as SPAR II®, styrene acrylates, or styrene methacrylates, colorants such as color pigment particles or dye compounds, and the aforementioned charge enhancing additive, or mixtures of charge additives in a concentration preferably ranging from about 0.5 percent to about 5 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 4 to about 25 microns, and preferably from about 4 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; polyurethanes; polyamides and polyimides; polyesters like SPAR II® available from Hercules Chemical Company; and the like. The polymer resins selected for the toner compositions of the present invention include homopolymers or copolymers of two or more monomers. Furthermore, the above mentioned polymer resins may also be crosslinked depending on the desired toner properties. Illustrative vinyl monomer units selected for the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol segments in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference, polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference copending U.S. Ser. No. 814,641, and U.S. Pat. No. 5,227,460, issued Jul. 13, 1993, to Mahabadi et al., the disclosures of which are totally incorporated herein by reference, can be selected as toner resins. Other specific toner resins include styrene-methacrylate copolymers and styrene-butadiene copolymers; PLIOLITES®; suspension polymerized styrene-butadienes, reference U.S. Pat. No. 4,558,108, the disclosure of which is totally incorporated herein by reference. Also, waxes with a molecular weight of from about 1,000 to about 6,000, such as polyethylene, polypropylene, and paraffin waxes, can be included in or on the toner compositions as fuser roll release agents.

The toner resin is present in a sufficient, but effective amount, for example from about 30 to about 95 weight percent. Thus, when 1 percent by weight of the charge enhancing additive is present, and 8 percent by weight of colorant, such as carbon black or color pigment, is contained therein, about 92 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent. Also, in embodiments the charge additive may be admixed with colloidal silica particles and adsorbed on the surface thereof, and the resulting product is then applied to the toner as a surface additive.

Numerous well known suitable color pigments or dyes can be selected as the colorant for the toner compositions including, for example, carbon black, like REGAL®330, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 70, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas such as AEROSIL®, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0:5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSIL® can be surface treated by adding the silicas to a solution of the charge additive in an amount of from about 1 to about 50 weight percent, and preferably 10 weight percent to about 25 weight percent, followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In embodiments, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 60 and 200 microns in volume average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toner composition of the present invention can be prepared by a number of known methods including extrusion melt blending the toner resins, colorants, and the hydroxy naphthoic acid derivative charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additive and other optional surface additives, or the charge enhancing additive-treated surface additive such as colloidal silicas. Further, other methods of preparation for the toner are as illustrated herein.

The toner and developer compositions of the present invention may be selected for use in electrostatographic imaging and printing apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 4 to about 25 microns, and more preferably from about 5 to about 12 microns. The triboelectric charging rates for the toners of the present invention are in embodiments less than 120 seconds, and more specifically, from about 15 to about 60 seconds as determined by the known charge spectrograph method as described herein before. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 30 grams per minute; and further, such toner compositions can be selected for high speed electrophotographic apparatuses, that is those exceeding 50 copies per minute.

The following Examples are being supplied to further illustrate various embodiments of the present invention, it being noted that these Examples are intended to illustrate and not limit the scope of the present invention. Comparative Examples are also presented.

EXAMPLE I

Preparation of 1,6-dibromo-2-hydroxy-3-naphthoic acid

2-Hydroxy-3-naphthoic acid (188.2 g, 1 mole) was heated to 90° C. in a 3 L flask containing 1,700 mL of glacial acetic acid until dissolved (about 20–30 minutes). A bromine solution consisting of 352 g of bromine and 100 mL of acetic acid was slowly added and evenly over 90 minutes to the 2-hydroxy-3-naphthoic acid solution, which was maintained at 90° C. After the addition was completed, the mixture was stirred and brought to reflux for 3 hours. The product mixture was then allowed to cool to room temperature slowly (over about 16 hours). A resulting precipitated solid was isolated by filtration and rinsed with 300 mL of acetic acid. The isolated solid was then suspended in 4 L of water and was stirred for 0.5 hour. The purified solid was filtered and washed with water 6×500 mL. After vacuum drying at 70° C., 290 g of pure 1,6-dibromo-2-hydroxy-3-naphthoic acid (84% yield) was obtained with the following properties.

m.p.: 254° C. (dec.) IR (KBr): 1674 $cm^{-1}$ (carboxylic acid) Calc'd for $C_{11}H_6O_3Br$: C, 38.19; H, 1.75; Br, 46.19. Found: C, 37.99; H, 1.77; Br, 46.32.

Application of the charge additive to the surface of AEROSIL and developer formulation The isolated charge additive compound, 0.3 gram, was dissolved in 100 mL of diethyl ether in a 250 mL round bottom flask. After dissolution, 3 grams of AEROSIL ®R972 from Degussa Company was added, and the resulting suspension was stirred for 0.5 hour. The ether solvent was then removed on a rotary evaporator, and the residue obtained was transferred to a crystallization dish where it was dried in a forced air oven, about 20 hours at 120° C. The solid was then transferred to a 4 ounce bottle and roll milled with 35 grams of ¼ inch steel shot for 30 minutes at a speed of about 90 feet per minute, yielding 3 grams of a fluffy white powder comprised of 10 weight percent of 1,6-dibromo-2-hydroxy-3-naphthoic acid and 90 weight percent of AEROSIL ®R972. The formed white powder charge additive and AEROSIL composite, 0.063 gram, was then added together with 12.5 grams of an experimental toner, 9 microns in average volume diameter, comprised of 100 percent of styrene butadiene (89/11), to a 4 ounce bottle containing 125 grams of steel shot of ¼ inch diameter and a bottle was then roll milled for 30 minutes.

Developer Preparation

A developer composition was then prepared by adding 1.25 grams of the above prepared toner and 60 grams of a steel core carrier, 130 microns in diameter, and 0.7 percent by weight of a surface coating of polymethylmethacrylate with 20 weight percent of KYNAR ®, to a roll mill. Mixing was accomplished for 60 minutes at a speed of about 90 feet per minute to generate a time zero developer. The tribo of the resulting toner as determined by the known Faraday Cage method at 20 percent RH was −65 microcoulombs per gram, and the admix rate was 2 minutes as determined in the known charge spectrograph.

EXAMPLE II

Sodium 1,6-dibromo-2-hydroxy-3-naphthoate

There was prepared a negative charge control additive, sodium 1,6-dibromo-2-hydroxy-3-naphthoate, by neutralizing the acid in Example I with an equivalent molar amount of NaOH in methanol. About 0.58 g of NaOH in 5 mL of water was added to a 100 mL methanol solution containing 5 g of 1,6-dibromo-2-hydroxy-3-naphthoic acid. After the mixture was stirred for 0.5 h, the solvent was removed on the evaporator. The residue was recrystallized from a minimum amount of warm water, yielding sodium 1,6-dibromo-2-hydroxy-3-naphthoate in about 90%.

m.p.:>300° C. IR(KBr): 1650 $cm^{-1}$ (carboxylate) Calc'd for $C_{11}H_5O_3Br_2Na$:C, 35.91; H, 1.37; Br 43.43; Na, 6.25 Found: C, 35.88, H, 1.39; Br, 44.05; Na, 5.69.

Surface Treatment of Charge Additive on AEROSIL

The above charge additive, 0.3 gram, as then dissolved in 100 mL of methanol in a 250 mL round bottom flask. After dissolution, 3 grams of AEROSIL® R972 from Degussa Company was added, and the resulting suspension was stirred for 0.5 hour. The methanol solvent was then removed on a rotary evaporator, and the residue obtained was transferred to a crystallization dish where it was dried in a forced air oven overnight, about 20 hours at 120° C. The solid was then transferred to a 4 ounce bottle and roll milled with 35 grams of ¼ inch steel shot for 30 minutes at a speed of about 90 feet per minute, yielding 3 grams of a fluffy white powder comprised of 10 weight percent of sodium 1,6-dibromo-2-hydroxy-3-naphthoate and 90 weight percent of AEROSIL® R972. The formed white powder charge additive composite, 0.063 gram, was then added together with 12.5 grams of an experimental toner, 9 microns in average volume diameter, comprised of 100 percent of styrene butadiene (89/11), to a 4 ounce bottle containing 125 grams of steel shot of ¼ inch diameter and the bottle was the roll milled for 30 minutes.

Developer Preparation

A developer composition was then prepared by adding 1.25 grams of the above prepared toner and 60 grams of steel core carrier, 130 microns in diameter, and 0.8 percent by weight of a surface coating of polymethylmethacrylate with 20 weight percent of KYNAR®, to a roll mill where mixing was accomplished for 60 minutes at a speed of about 90 feet per minute to generate a time zero developer. The tribo of the resulting toner as determined by the known Faraday Cage method at 20% RH was −68 microcoulombs per gram, and the admix rate was 15 seconds as determined in the known charge spectrograph.

EXAMPLE III

There was prepared a surface-treated silica consisting of 10% by weight of 2-hydroxy-3-naphthoic acid and 90% of AEROSIL® R972 using the process described in Example II. The surface-treated silica was then incorporated into toner and developer using the formulation and evaluation procedures of Example II. The tribo of the toner is −75 μC/g and the admix time was 5 minutes as determined in the known charge spectrograph.

COMPARATIVE EXAMPLE I

The processes of Example II were repeated except that there was selected as the toner charge additive LR120 (from Japan Carlit, potassium bis(3,5-di-t-butylsalicyato borate)) in place of the sodium 1,6-dibromo-2-hydroxy-3-naphthoate. The toner tribo was −41 μC/g and the admix was 5 minutes. The charge additives of Examples I and II consistently gave higher tribo with improved admix properties compared to the results of this Example.

EXAMPLE IV

A model toner consisting of 0.1% by weight of 1,6-dibromo-2-hydroxy-3-naphthoic acid applied directly on the surface of the 9 micron styrene/butadiene (89/11) toner was prepared by the aforementioned solution coating technique. Specifically, a 9 micron styrene/butadiene (89/11) toner, 12.5 g, was added to a methanol solution coating 0.125 g of 1,6-dibromo-2-hydroxy-3-naphthoic acid in 100 mL of methanol. After stirring the mixture for half an hour, the solvent was removed on an evaporator and the resulting toner was vacuum dried at room temperature for 16 hours. Two developers were prepared using the formulation in Example I and they were each separately placed in a glove-box and equilibrated at 20% RH and 80% RH, respectively. The tribos of these toners determined as described in Example I were −28 and −45 microC/g, respectively.

The results indicated that the charge additives of the present invention do not lose their charging ability or chargability at high RH.

EXAMPLE V

Another model toner consisting of 0.1% by weight of 2-hydroxy-3-naphthoic acid on the surface of a 9 micron styrene/butadiene (89/11) toner was prepared and tested using the procedures described in Example IV. The tribo results were as follows:

| 20% RH tribo | 80% RH tribo |
|---|---|
| −18.8 microC/g | −34.9 microC/g |

EXAMPLE VI

A model toner consisting of 0.1% by weight of 2,8-dihydroxy-3-naphthoic acid on the surface of a 9 micron styrene/butadiene (89/11) toner was prepared and tested according to procedures described in Example IV. The toner tribo results were as follows:

| 20% RH | 80% RH |
|---|---|
| −34.2 microC/g | −44.6 microC/g |

The above mentioned patents and publications are incorporated by reference herein in their entirety.

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of resin particles, pigment particles, optional surface additives, and a hydroxy naphthoic acid charge enhancing additive of the following formula:

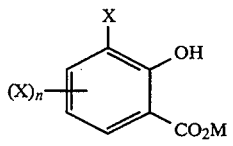

wherein X is halogen, M is selected from the group consisting of hydrogen, an alkaline earth metal, an alkali metal, and $NR_4$ wherein R is alkyl with from 1 to 5 carbon atoms, and n is the number 1 or 2.

2. A toner composition in accordance with claim 1 wherein M is selected from the group consisting of hydrogen, lithium, sodium, potassium, cesium, magnesium $(Mg^{2+})_{\frac{1}{2}}$, calcium $(Ca^{2+})_{\frac{1}{2}}$, barium $(Ba^{2+})_{\frac{1}{2}}$, and $NR_4$ and R is methyl.

3. A toner composition in accordance with claim 1 wherein X is iodide or bromide.

4. A toner composition in accordance with claim 1 wherein the charge additive is present in an amount of from about 0.01 to about 5 weight percent.

5. A toner composition in accordance with claim 1 wherein the charge additive is present in an amount of from about 0.1 to about 3 weight percent.

6. A toner composition in accordance with claim 1 wherein the charge additive is incorporated into the toner resin particles.

7. A toner composition in accordance with claim 1 wherein the charge additive is present on the surface of the toner particles of the toner composition.

8. A toner composition in accordance with claim 1 wherein the charge enhancing additive is contained on the surface of the optional surface additives selected from the group consisting of colloidal silica particles, titanium oxide particles and mixtures therof.

9. A toner composition in accordance with claim 1 wherein the rate of charging of said toner is from about 15 seconds to about 120 seconds by frictional charging against carrier particles.

10. A toner composition in accordance with claim 1 with a negative triboelectric charge of from between about −10 to about −50 microcoulombs per gram.

11. A toner composition in accordance with claim 1 wherein the resin particles are comprised of styrene acrylates, styrene methacrylates, polyesters, and styrene butadienes.

12. A toner composition in accordance with claim 1 containing a wax component which has a weight average molecular weight of from about 1,000 to about 6,000.

13. A toner composition in accordance with claim 12 wherein the waxy component is selected from the group consisting of polyethylene and polypropylene.

14. A toner composition in accordance with claim 1 wherein the surface additives are metal salts of a fatty acid, colloidal silicas, titanium oxides, or mixtures thereof.

15. A toner composition in accordance with claim 1 wherein the pigment particles are selected from the group consisting of carbon black, magnetites, cyan, magenta, yellow, red, blue, green, brown pigments, and mixtures thereof.

16. A toner composition in accordance with claim 1 wherein the toner has a high relative humidity (RH) resistant property wherein when the ambient RH increases the triboelectric charging of the toner composition becomes more negative.

17. A toner composition in accordance with claim 16 wherein the toner triboelectric charging is of from about −30 to about −50 microcoulombs/gram at a relative humidity of 80 percent.

18. A toner composition in accordance with claim 16 wherein the toner triboelectric charging is of from about −15 to about −30 microcoulombs/gram at a relative humidity of 20 percent.

19. A toner composition in accordance with claim 1 wherein the charge enhancing additive is selected from the group consisting of 1,6-dibromo-2-hydroxy-3-naphthoic acid, lithium 1,6-dibromo-2-hydroxy-3-naphthoate, and 1,6-diiodo-2-hydroxy-3-naphthoic acid.

20. A developer composition comprised of a toner composition comprising resin particles, pigment particles, optional surface additives, and a hydroxy naphthoic acid derivative charge enhancing additive of the following formula:

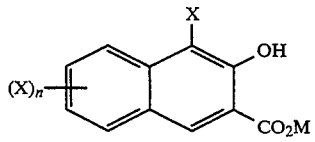

wherein X is halogen, M is selected from the group consisting of hydrogen, an alkaline earth metal, an alkali metal, and $NR_4$ wherein R is alkyl with from 1 to 5 carbon atoms, and n is the number 1 or 2, and carrier particles.

21. A developer composition in accordance with claim 20 wherein the carrier particles are comprised of ferrites, steel, or an iron powder with a polymer or mixtures of polymers coating thereover.

22. A developer composition in accordance with claim 21 wherein the coating is comprised of a methyl terpolymer, a polyvinylidine fluoride, a polymethyl methacrylate, or a mixture of polymers not in close proximity in the triboelectric series.

* * * * *